US007112248B2

(12) United States Patent
Yamaguchi

(10) Patent No.: US 7,112,248 B2
(45) Date of Patent: Sep. 26, 2006

(54) VACUUM CARBO-NITRIDING METHOD

(75) Inventor: Kazuyoshi Yamaguchi, Tenri (JP)

(73) Assignee: Koyo Thermo Systems Co., Ltd., Tenri (JP)

( * ) Notice: Subject to any disclaimer, the term of this patent is extended or adjusted under 35 U.S.C. 154(b) by 117 days.

(21) Appl. No.: 10/485,827

(22) PCT Filed: Dec. 13, 2001

(86) PCT No.: PCT/JP01/10954

§ 371 (c)(1),
(2), (4) Date: Feb. 18, 2004

(87) PCT Pub. No.: WO03/050321

PCT Pub. Date: Jun. 19, 2003

(65) Prior Publication Data

US 2004/0250921 A1 Dec. 16, 2004

(51) Int. Cl.
*C23C 8/34* (2006.01)

(52) U.S. Cl. ..... 148/218; 148/219; 148/223

(58) Field of Classification Search ..... 148/218–219, 148/223

See application file for complete search history.

(56) References Cited

U.S. PATENT DOCUMENTS 5,268,040 A * 12/1993 Naito et al. ..... 148/233

FOREIGN PATENT DOCUMENTS

| | | | |
|---|---|---|---|
| JP | 49-10124 | | 1/1974 |
| JP | 62-033757 | * | 2/1987 |
| JP | 11-158601 | | 6/1999 |
| JP | 11158601 | * | 6/1999 |
| JP | 2000-336469 | | 12/2000 |
| JP | 2001262313 | * | 9/2001 |

OTHER PUBLICATIONS

Davis et al. ASM Handbook, 1995, ASM International, vol. 2, 376-379.*

* cited by examiner

*Primary Examiner*—Roy King
*Assistant Examiner*—Michael P. Alexander
(74) *Attorney, Agent, or Firm*—Armstrong, Kratz, Quintos, Hanson & Brooks, LLP.

(57) ABSTRACT

A vacuum carbonitriding method includes: performing a vacuum carburizing process on an object to be treated (a workpiece) in a heat treating furnace under reduced pressures by supplying a carburizing gas into the furnace that has been heated to a predetermined carburizing temperature; stopping supply of the carburizing gas while keeping the carburizing temperature so as to diffuse carbon in the workpiece under reduced pressures; and performing a nitriding process on the workpiece by supplying a nitriding gas into the furnace under reduced pressures after lowering the furnace temperature. Required heat treatment qualities such as surface hardness, effective case depth, toughness and the like can be achieved in a short time with reproducibility even in a case of workpiece made of low-grade steel or case-hardened steel.

3 Claims, 4 Drawing Sheets

VACUUM CARBO-NITRIDING METHOD

TECHNICAL FIELD

The present invention relates to a vacuum carbonitriding method performed under reduced pressures.

BACKGROUND ART

As a vacuum carburizing method of performing a carburizing process on steel parts for automobile such as gears, bearings, fuel injection nozzles and constant velocity joints, for example, a method of using ethylene gas as a carburizing gas to perform the process under reduced pressures of 1 to 10 kPa in a vacuum heat treating furnace has been known (see Japanese Unexamined Patent Publication No. 11-315363).

In the conventional method, however, when the vacuum carburization is performed while disposing a basket which carries a number of objects to be treated (workpieces) in an effective heating space where uniformity of temperature is ensured in the vacuum heat treating furnace, there arises a problem that unevenness of carburization occurs in the workpieces depending on the carried position in the basket, and variation occurs in carburization quality such as effective case depth (carburization depth) and surface carbon concentration among workpieces in different carried positions.

Thus, as a vacuum carburizing method which solves the above described problem, the present applicant has previously proposed a method of using a mixed gas of ethylene gas and hydrogen gas as a carburizing gas (see Japanese Unexamined Patent Publication No. 2001-262313).

In the vacuum carburizing method previously proposed by the present applicant, even when carburization is performed while disposing a number of workpieces in an effective space where uniformity of temperature is ensured in the vacuum heat treating furnace, it is possible to prevent unevenness of carburization from occurring in all workpieces, so that carburization quality of all the workpieces can be made uniform.

In the method disclosed in Japanese Unexamined Patent Publication No. 2001-262313, however, low grade steels, for example, steels containing a high proportion of impurities such as MnS, low alloy steels, low carbon steels and the like would not be hardened by hardening by means of quenching after carburization, which leads to a problem that sufficient surface hardness and effective case depth cannot be obtained. In addition, if ammonia gas is introduced into the vacuum heat treating furnace together with ethylene gas and hydrogen gas for the purpose of obtaining a surface hardened case in low grade steels, retained austenite increases or cementite becomes likely to precipitate. In particular, when ammonia gas is introduced together with ethylene gas and hydrogen gas, it is necessary to elongate the process time in order to increase the effective case depth, which leads to a problem of increased cost. In addition, in the case of case-hardened steels, a plenty of cementite will precipitate, which leads to a problem that the steel becomes brittle and cracking becomes likely to occur.

The present invention has been made in order to solve the above described problems, and it is an object of the present invention to provide a vacuum carbonitriding method capable of obtaining necessary heat treatment quality such as surface hardness, effective case depth, toughness and the like in short time and with reproducibility even in a case of a workpiece made of low-grade steel or case-hardened steel.

DISCLOSURE OF THE INVENTION

A vacuum carbonitriding method of claim 1 includes: performing a vacuum carburizing process on a workpiece in a heat treating furnace under reduced pressures by supplying a carburizing gas into the furnace that has been heated to a predetermined carburizing temperature; stopping supply of the carburizing gas while keeping the carburizing temperature so as to diffuse carbon in the workpiece under reduced pressures; and performing a nitriding process on the workpiece by supplying a nitriding gas into the furnace under reduced pressures after lowering the furnace temperature.

According to the vacuum carbonitriding method of claim 1, even in the case of a workpiece made of low-grade steel, it is possible to improve the surface hardness by preventing the amount of retained austenite in the surface layer from becoming excessive, as well as to increase the effective case depth in a relatively short time. In addition, it is possible to readily control the effective case depth and obtain a desired effective case depth with reproducibility. Furthermore, even in the case of a workpiece made of case-hardened steel, it is possible to reduce the amount of precipitation of cementite on the surface layer, and to prevent cracking from occurring by improving the toughness.

A vacuum carbonitriding method of claim 2 includes: using a mixed gas of ethylene gas and hydrogen gas as the carburizing gas in the method of claim 1.

A vacuum carbonitriding method of claim 3 includes: controlling effective case depth of the workpiece after quenching, which is performed following the nitridation, on the basis of a nitriding time in the method of claim 1 or 2. In this case, by changing the nitriding time, it is possible to obtain effective hardened cases of different depths with reproducibility.

BEST MODE FOR CARRYING OUT THE INVENTION

Hereinafter, embodiments of the present invention will be described with reference to the drawings.

Figure 1:
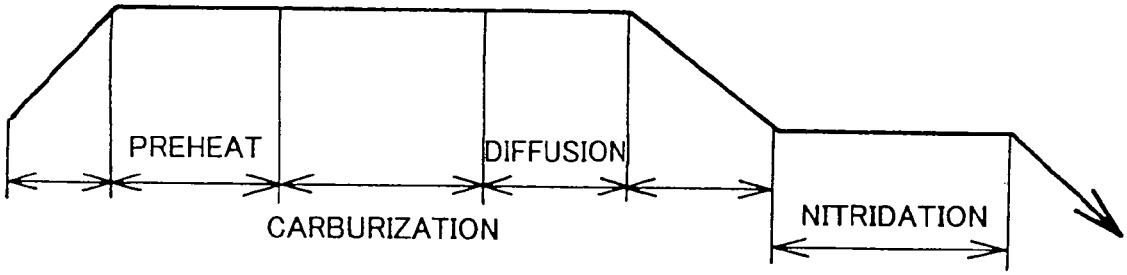
FIG. 1 is a diagram showing a processing pattern of a vacuum carbonitriding method according to the present invention.

FIG. 1 shows a processing pattern of a vacuum carbonitriding method according to the present invention.

As shown in FIG. 1, vacuum carbonitriding is performed as follows. Specifically, after disposing workpieces in a vacuum heat treating furnace, the internal pressure of the furnace is reduced by means of an evacuating system. Then after performing a preheating process by heating the interior of the furnace to a predetermined carburizing temperature, a carburizing process is performed while supplying with a carburizing gas, for example, a mixed gas of ethylene gas and hydrogen gas. Next, supply of ethylene gas and hydrogen gas is stopped, and a diffusing process is performed at a diffusing temperature which is equal to the carburizing temperature. Next, after lowering the interior temperature of the furnace to a predetermined nitriding temperature, a nitriding process is performed while supplying with a nitriding gas, for example ammonia gas, and finally oil quenching is performed. During the period from start of heating the interior of the vacuum heat treating furnace to end of the nitridation process, evacuation of the furnace is continuously performed by means of the evacuating system.

In the processing pattern as described above, it is preferred that the carburizing temperature is in the range of 870 to 1050° C., for example, in the range of 930 to 950° C., and the nitriding temperature is in the range of 780 to 900° C. and lower than the carburizing temperature. The preheating time varies depending on the carburizing temperature, shape of the workpiece, and is preferably in the range of 35 to 40 minutes. The carburizing temperature, diffusing time and nitriding time are variable depending on the intended effective case depth. The rate of temperature decrease from the carburizing temperature to the nitriding temperature is changed in accordance with the weight (load weight) of the workpieces that are processed at once. It is preferred that the furnace pressure at the time of carburization is in the range of 3 to 9 kPa, and the furnace pressure at the time of nitridation is in the range of 3 to 9 kPa.

Figure 2:
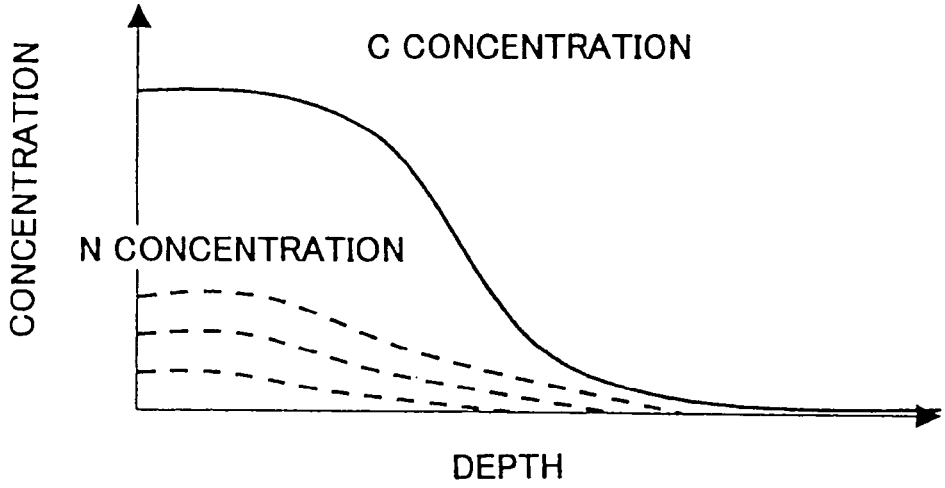
FIG. 2 is a conceptual diagram showing carbon concentration and nitrogen concentration in a surface layer of a workpiece which has been subjected to a vacuum carbonitriding process according to a method of the present invention.

In the case where vacuum carbonitriding process is performed following the processing pattern shown in FIG. 1, the surface layer of the workpiece has a carbon concentration (see the solid line in FIG. 2) and a nitrogen concentration (see the broken line in FIG. 2) both of which decrease as the depth from the surface decreases. The nitrogen concentration increases as the nitriding time increases.

Next, concrete examples of the present invention will be described together with a comparative example.

Figure 3:
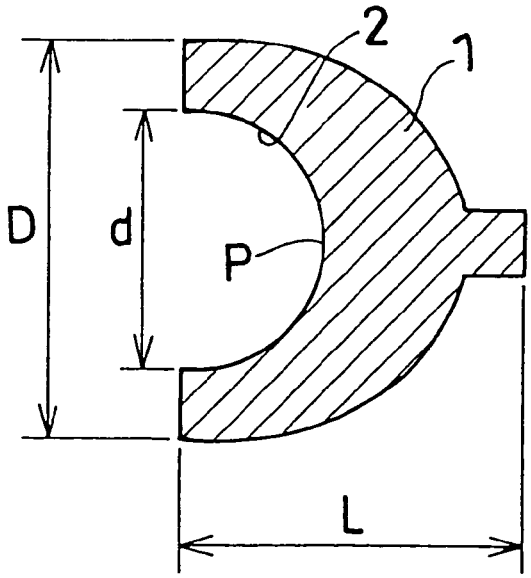
FIG. 3 is a longitudinal sectional view showing a workpiece which is used in Examples 1 to 3 and Comparative Example.

As a workpiece, a cup end (1) for pushrod having a shape shown in FIG. 3 made of JIS SWCH10R was used. This cup end (1) has a total length L of 13.5 mm, an outer diameter D of 14 mm, and has a spherical recess (2). The recess (2) has an inner diameter d of 4.5 mm.

EXAMPLE 1

A plurality of cup ends (1) were loaded in the lower basket of two baskets piled in such a manner that the opening of the recess (2) was directed downward, while a plurality of dummies were loaded in the upper basket of the two baskets piled. The baskets piled were then disposed in an effective heating space where uniformity of temperature was secured in a vacuum heat treating furnace. The total weight of the cup ends (1) was 17.5 kg, the total weight of the cup ends, dummies, baskets and tray was 75.5 kg.

Then after reducing the pressure of the interior of the vacuum heat treating furnace to 0.14 kPa or less over 8 minutes, the effective heating space in the furnace was heated to 930° C. over 14 minutes, and kept at this temperature for 40 minutes so as to perform a preheating process. Subsequent to the preheating process, a carburizing process was performed which involves keeping at 930° C. for 100 minutes under the pressure of 7 to 8 kPa while supplying the heat treating furnace with ethylene gas and hydrogen gas. This process was performed under the control such that the flow rate of ethylene gas was 20 litters per minute, and the flow rate of the hydrogen gas was 10 litters per minute. Subsequent to the carburization process, supply of ethylene gas and hydrogen gas was stopped, and kept at 930° C. for 80 minutes so as to perform a diffusing process. Next, after lowering the temperature to 850° C. over 34 minutes, the furnace was kept at 850° C. for 180 minutes under the pressure of 2 to 4 kPa while supplying ammonia gas so as to perform a nitridation process. Subsequent to the nitridation process, quenching in a quenchant oil at 60° C. composed of Daphne Quench HV (manufactured by IDEMITSU) was performed followed by 20-minute oil cooling. The oil surface pressure was 10 kPa, and the quenchant oil was stirred by rotating an oil stirrer at 440 rpm. Finally, a tempering process which involves keeping at 150° C. for 90 minutes was performed. Thus, the vacuum carbonitriding process was performed on the cup ends (1).

EXAMPLE 2

The vacuum carbonitriding process was performed on the cup ends (1) in the same manner as in Example 1 except that the nitriding time was changed to 120 minutes.

EXAMPLE 3

The vacuum carbonitriding process was performed on the cup ends (1) in the same manner as in Example 1 except that the nitriding time was changed to 60 minutes.

COMPARATIVE EXAMPLE

Cup ends (1) were loaded in the baskets together with dummies in the same manner as described in Example 1.

After reducing the pressure of the interior of the vacuum heat treating furnace to 0.14 kPa or less over 10 minutes, the effective heating space in the furnace was heated to 850° C. over 10 minutes, and kept at this temperature for 40 minutes so as to perform a preheating process. Subsequent to the preheating process, a carbonitriding process was performed which involves keeping at 850° C. for 160 minutes under the pressure of 4 to 5 kPa while supplying the heat treating furnace with ethylene gas, hydrogen gas and ammonia gas. This process was performed under the control that the flow rate of ethylene gas was 10 litters per minute, the flow rate of the hydrogen gas was 5 litters per minute, and the flow rate of the ammonia gas was 10 litters per minute. Subsequent to the carbonitriding process, after stopping supply of ethylene gas, hydrogen gas and ammonia gas, quenching in a quenchant oil at 60° C. composed of Daphne Quench HV (manufactured by IDEMITSU) was performed followed by 20-minute oil cooling. The oil surface pressure was 10 kPa, and the quenchant oil was stirred by rotating an oil stirrer at 440 rpm. Finally, a tempering process which involves keeping at 150° C. for 90 minutes was performed. In this manner, the vacuum carbonitriding process was performed on the cup ends (1).

EVALUATION TEXT

Hardness at the deepest point P of the bottom surface (see FIG. 3) in the recess (2) was measured by the method specified by JIS G0577 for each cup end (1) having subjected to the respective vacuum carbonitriding processes in Examples 1 to 3 and Comparative Example. As for Examples 1 and 2, distribution of hardness at depths of 0.1 mm to 1.5 mm from the top surface of the deepest point P was determined. As for Example 3, distribution of hardness at depths of 0.1 mm to 1.0 mm from the top surface of the deepest point P was determined. As for Comparative Example, distribution of hardness at depths of 0.1 mm to 1.2 mm from the top surface of the deepest point P was determined. Results of Example 1, Example 2, Example 3 and Comparative Example are shown in FIG. 4, FIG. 5, FIG. 6 and FIG. 7, respectively.

Figure 4:
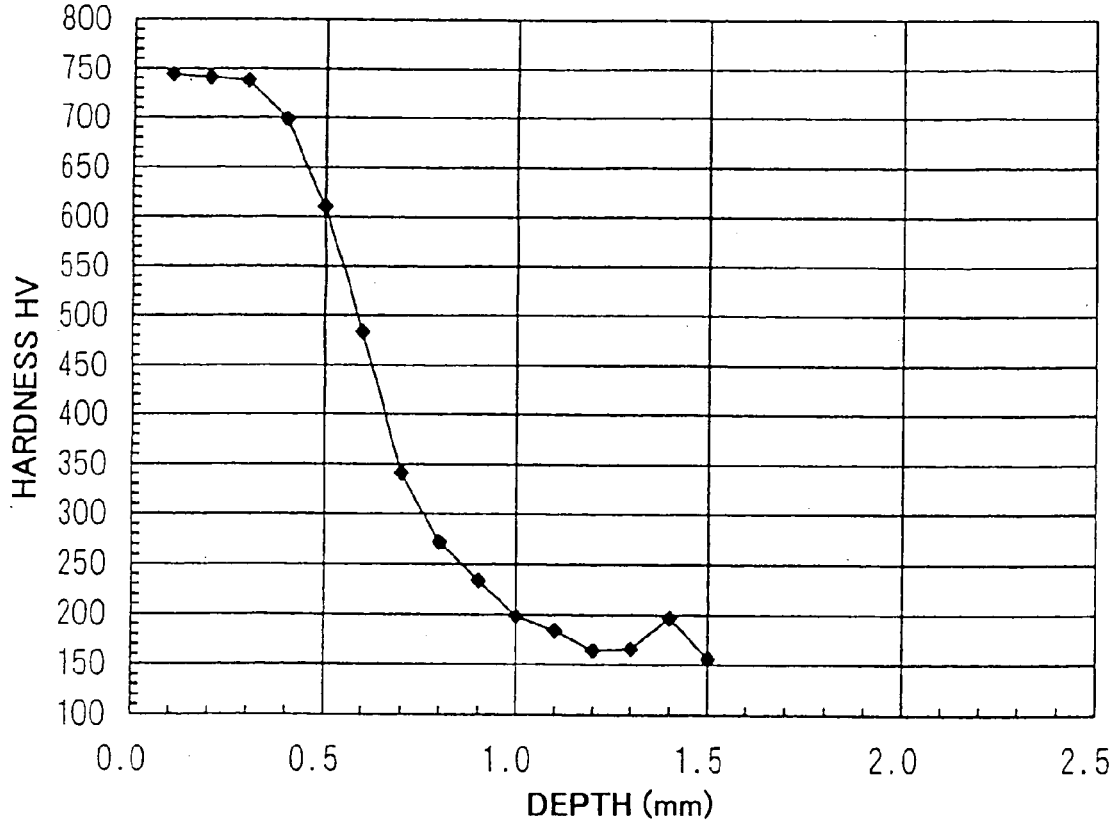
FIG. 4 is a graph showing distribution of hardness in a surface layer of a workpiece that has been subjected to a vacuum carbonitriding process according to Example 1.

As is apparent from FIG. 4, as for Example 1, the hardness at a depth of 0.1 mm from the top surface of the deepest point P is Hv744, and the effective case depth having a hardness of Hv550 is 0.55 mm.

Figure 5:
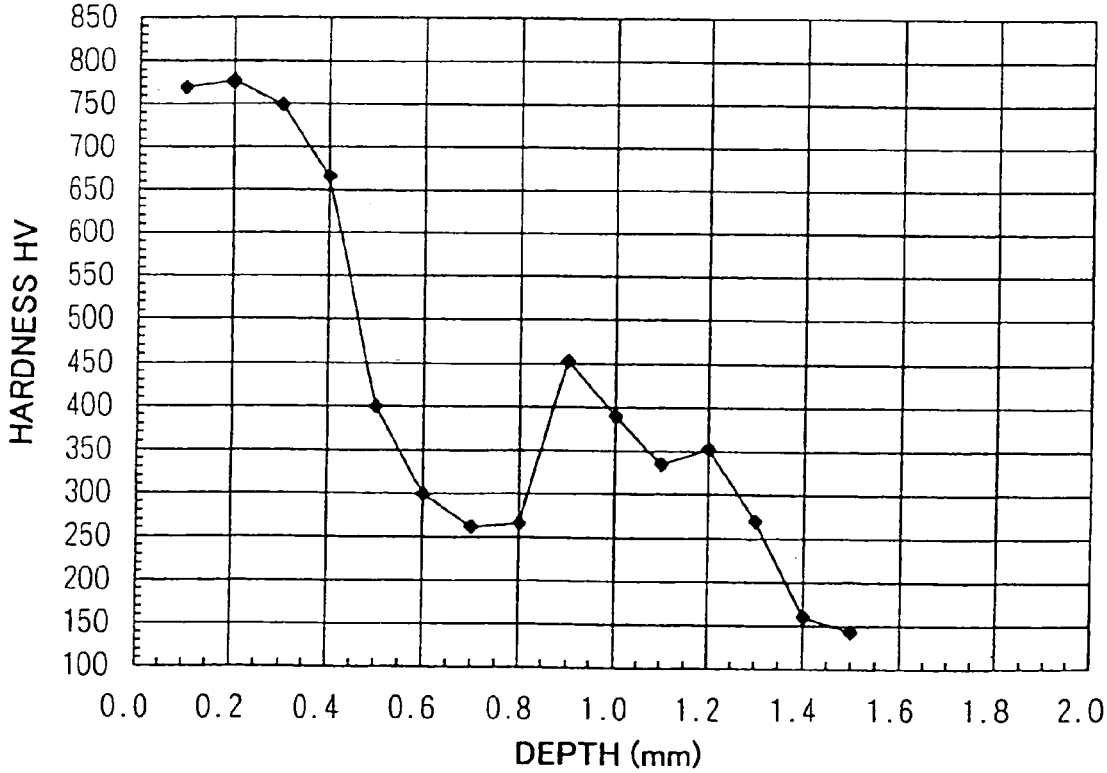
FIG. 5 is a graph showing distribution of hardness in a surface layer of a workpiece that has been subjected to a vacuum carbonitriding process according to Example 2.

As is apparent from FIG. 5, as for Example 2, the hardness at a depth of 0.1 mm from the top surface of the deepest point P is Hv770, and the effective case depth having a hardness of Hv550 is 0.44 mm.

Figure 6:
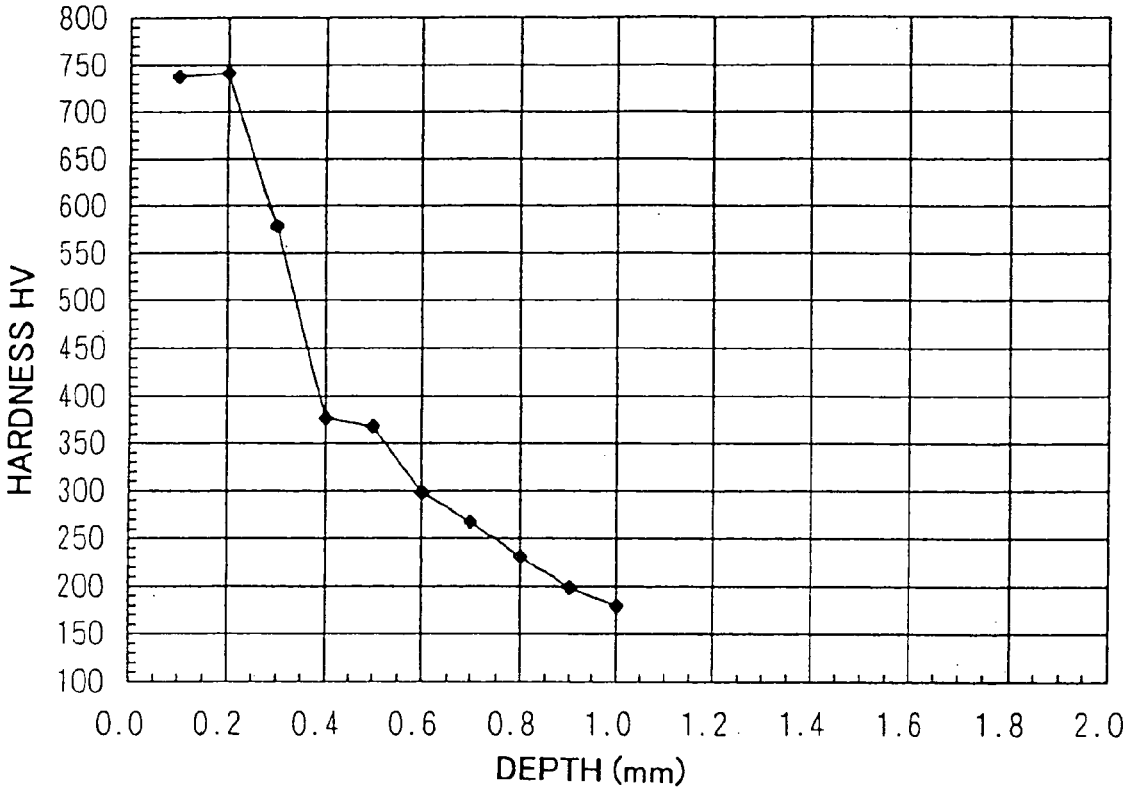
FIG. 6 is a graph showing distribution of hardness in a surface layer of a workpiece that has been subjected to a vacuum carbonitriding process according to Example 3.

As is apparent from FIG. 6, as for Example 3, the hardness at a depth of 0.1 mm from the top surface of the deepest point P is Hv740, and the effective case depth having a hardness of Hv550 is 0.31 mm.

Figure 8:
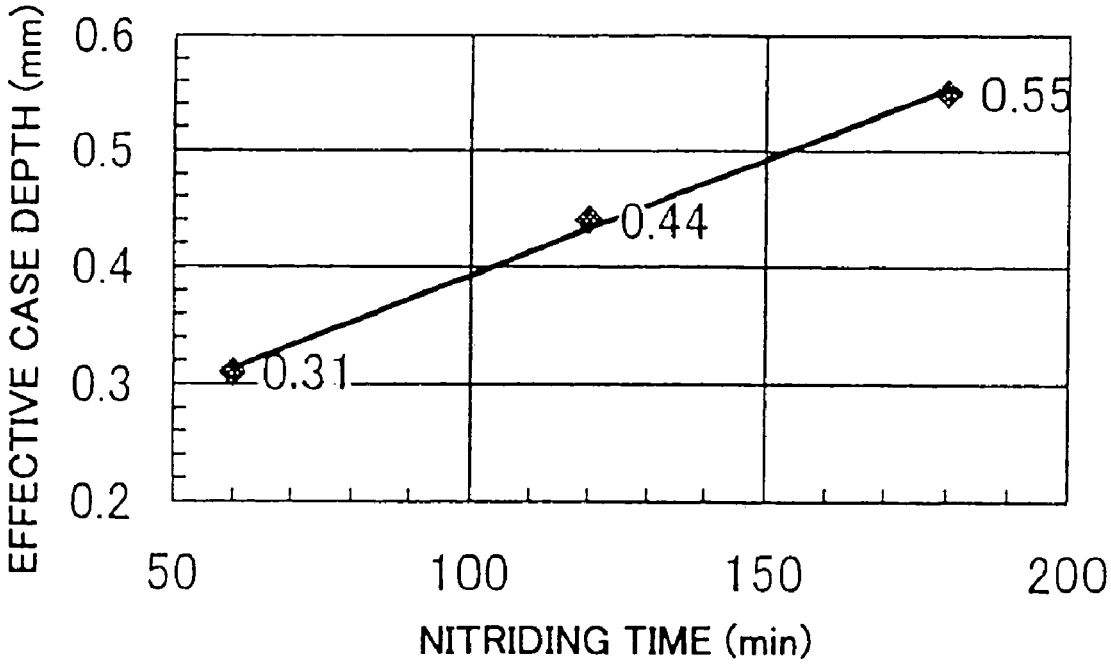
FIG. 8 is a graph showing relationship between nitriding time and effective case depth in Examples 1 to 3.

Now shown in FIG. 8 are relationships between nitriding time and effective case depth in Examples 1 to 3. As is apparent from FIG. 8, it is revealed that effective case depth is in proportion to nitriding time.

Figure 7:
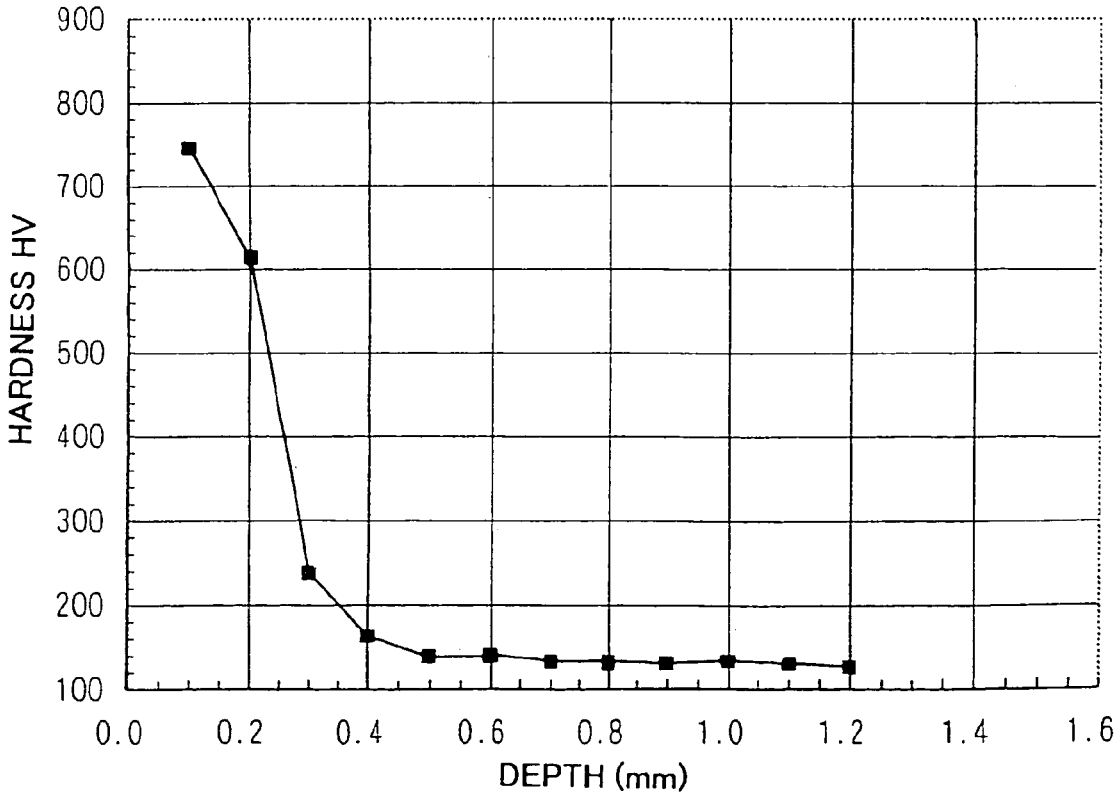
FIG. 7 is a graph showing distribution of hardness in a surface layer of a workpiece that has been subjected to a vacuum carbonitriding process according to Comparative Example.

As is apparent from FIG. 7, as for Comparative Example, the hardness at a depth of 0.1 mm from the top surface of the deepest point P is Hv730, and the effective case depth having a hardness of Hv550 is 0.22 mm. In order to realize the hardness of Hv550 at an effective depth of 0.55 mm, the carbonitriding time should be 560 minutes as determined by calculation.

In observation of the surface layer of the deepest point P of the bottom surface in the recess (2) of each cup end (1) having subjected to the vacuum carbonitriding processes according to Examples 1 to 3, a desirably tempered martensitic structure was observed while no retained austenite nor cementite was observed. To the contrary, in observation of the surface layer of the deepest point P of the bottom surface in the recess (2) of each cup end (1) having subjected to the vacuum carbonitriding process according to Comparative Example, a plenty of retained austenite and cementite existed. In addition, a plenty of soot was adhered to the surface of the cup end (1).

INDUSTRIAL APPLICABILITY

As described above, the vacuum carbonitriding method according to the present invention is useful for carrying out a carbonitriding process for low-grade steels or case-hardened steels, and is particularly suitable to obtain required heat treatment qualities such as surface hardness, effective case depth, toughness and the like in a short time with reproducibility even in a case of workpieces made of low-grade steels or case-hardened steels.

The invention claimed is:

1. A vacuum carbonitriding method comprising:

performing a vacuum carburizing process on an object to be treated in a heat treating furnace under reduced pressures by supplying a carburizing gas into the furnace that has been heated to a predetermined carburizing temperature;

performing a diffusing process on the object to be treated by stopping supply of the carburizing gas while keeping the carburizing temperature so as to diffuse carbon in the object to be treated under reduced pressures for a predetermined period of time based on the intended effective case depth; and performing a nitriding process on the object to be treated by supplying a nitriding gas into the furnace under reduced pressures after lowering the furnace temperature.

2. The vacuum carbonitriding method according to claim 1, comprising:

using a mixed gas of ethylene gas and hydrogen gas as the carburizing gas.

3. The vacuum carbonitriding method according to claim 1 or 2, comprising:

controlling effective case depth of the object to be treated after quenching, which is performed following the nitridation, on the basis of a nitriding time.

* * * * *